US005650011A

United States Patent [19]

Yoshinaga

[11] Patent Number: 5,650,011

[45] Date of Patent: Jul. 22, 1997

[54] DUPLEX TYPE COATING APPARATUS

[75] Inventor: Hidetoshi Yoshinaga, Nara, Japan

[73] Assignee: Hirano Tecseed Co., Ltd., Nara, Japan

[21] Appl. No.: 563,149

[22] Filed: Nov. 27, 1995

[30] Foreign Application Priority Data

Nov. 28, 1994 [JP] Japan ..... 6-292819
Nov. 2, 1995 [JP] Japan ..... 7-285689

[51] Int. Cl.[6] ..... B05C 3/02

[52] U.S. Cl. ..... 118/413; 118/316; 118/325; 118/405; 118/419; 118/683

[58] Field of Search ..... 118/313, 315, 118/316, 325, 405, 419, 683, 674, 664, 712, 407, 410, 413

[56] References Cited

U.S. PATENT DOCUMENTS 4,231,318 11/1980 Zink ..... 118/122
4,872,417 10/1989 Kuwabara et al. ..... 118/411
5,067,432 11/1991 Lippert ..... 118/413

FOREIGN PATENT DOCUMENTS 3-72976 3/1991 Japan .
03072976 A 3/1991 Japan .

*Primary Examiner*—Donald E. Czaja
*Assistant Examiner*—Steven B. Leavitt
*Attorney, Agent, or Firm*—Jordan and Hamburg

[57] ABSTRACT

A duplex type coating apparatus capable of applying a coating material to the opposite sides of a moving web while causing the applied coating film to remain identical in thickness on each side has a pair of spaced apart die units disposed at the opposite sides of the web. The web is driven to vertically travel under tension between the dies along a predefined path of travel with a gap defined between each web side and an associated one of the dies. Each die has a liquid reservoir and a transversely elongated slot orifice, or discharge port, at the distal end thereof opposing a corresponding side of the moving web. The dies are operatively coupled to constant fluid feed pumps which supply the reservoirs with a specified amount of coating fluid, enabling the discharge ports to apply an identical amount of coating fluid onto each web surface. The fluid feed amount is chosen such that it is kept equivalent to the product of a preset coat thickness and width as well as the web's traveling speed.

10 Claims, 5 Drawing Sheets

DUPLEX TYPE COATING APPARATUS

BACKGROUND OF THE INVENTION

1. Field of the Invention

The present invention relates to a duplex type coating apparatus which is capable of simultaneously applying a coating liquid to opposite sides of a web such as an elongated fabric, a plastic film and a metal sheet.

2. Description of Related Art

One known duplex type coating apparatus is a twin-blade type coating apparatus.

The twin-blade type coating apparatus includes a pair of dies arranged at opposite sides of the path of travel of a web, and a pair of blades disposed above the pair of dies. A coating liquid is applied from the pair of dies to opposite sides of the web while the web is being moved up along a vertical path. Thereafter, the blades scrape excess coating liquid so as to maintain the thickness of a coating constant (U.S. Pat. No. 4,231,318).

However, a disadvantage with this arrangement is that the thickness of the coating is subject to change when lateral displacement of the web occurs.

To this end, there has been proposed another duplex type coating apparatus.

Specifically, a coating liquid is fed from a pair of dies under the same pressure while a web is being moved center of the pair of dies. If the web is displaced either to the right or left, then the die is moved so as to change the pressure of the coating liquid to provide a constant coating thickness (JP-A-03072976).

To provide a constant thickness, the duplex type coating apparatus requires movement of one of the dies. The adjustment of thickness in this way is, however, difficult.

Accordingly, the present invention provides a duplex type coating apparatus which readily ensures constant thickness of a coating on opposite sides of the web.

Recently, a portable cellular telephone or portable informative terminals have come into increasing use. To this end, a spiral electrode type lithium battery is fabricated on a mass production basis. When the litium battery is manufactured on a large-scale, a slurry composite material (coating liquid) mainly consisting of an electrode activating substance is coated on a hoop member (web) mode of a bandlike copper or aluminum foil. In that case, it is necessary to form coated and uncoated areas of predetermined lenghts, respectively, in an alternative fashion and it is also necessary to apply coatings at the same position on both opposing surfaces of the web. Moreover, the coated and uncoated areas must be formed at the same position on the opposite sides of the web.

These two conventional duplex type coating apparatus are able to continuously apply a coating liquid to the web, but unable to alternately provide coated and uncoated areas on the web.

Accordingly, the present invention further provides a duplex type coating apparatus which can provide a coating on opposite sides of the web and allows for intermittent coating.

OBJECT OF THE INVENTION

The present invention provides a duplex type coating apparatus which readily ensures constant thickness of a coating on opposite sides of a web.

Also, the present invention provides a duplex type coating apparatus which can apply a coating liquid to opposite sides of a web in an intermittent manner.

To attain the foregoing objects, the present invention provides a duplex type coating apparatus which includes a pair of spaced-apart die devices arranged at the opposite sides of a web moving at specified rates along a predetermined path of travel. The dies each have a coating liquid reservoir defined therein and a transversely elongated slot orifice or discharge port disposed on a corresponding one of opposite sides of the web which extend along a width of the web for applying a stream of coating liquid onto the opposite sides of the moving web which is maintained under tension. The dies are operatively coupled to a pair of coating liquid supply devices, each of which supplies the coating liquid to the liquid reservoir in an associated one of the dies at a specifically chosen feed amount per unit time corresponding in value to the web's travel rate multiplied by a preset coat thickness and a preset coat width. Each of the supply devices simultaneously apply substantially the same amount of coating liquid to the opposite sides of the moving web through the discharge ports, forcing the liquid to be deposited thereon with the preset coat thickness and the preset coat width maintained.

In accordance with one aspect of the invention, the coating apparatus further includes a web speed sensor that monitors and detects the travel speed of the web and constant delivery pumps which provide the dies with a constant amount of coating liquid per rotation of the constant delivery pumps. A controller is provided for controlling the operation of the pumps in such a way that the number of rotation (rotation rate) is given as:

$$N=(D\times W\times V)/(K1\times Q),$$

where N is the number of rotation, D is the preset thickness of a wet coating, W is the predefined width of the coating on the web, Q is the discharged amount of the coating liquid per rotation of the pumps, and K1 is a constant.

In accordance with another aspect of the invention, the coating apparatus may further include one or more thickness sensors which monitor and detect an average value of a thickness Dp of an actually dispensed coating film on each side of the moving web along the width thereof. A further controller is provided for controlling operation of the pumps such that the rotation number N is substantially equal to $(Ds\times V\times K0)/Dp$, where Ds is the required thickness of the wet coating to be applied to the web, and K0 is a constant.

These and other objects, features and advantages of the invention will be apparent from the following more particular description of one preferred embodiment of the invention, as illustrated in the accompanying drawings.

DETAILED DESCRIPTION OF THE INVENTION

A duplex type coating apparatus 10 according to one embodiment of the present invention will now be described with reference to the drawings. For the purpose of explanation, the terms "left" and "right" used herein are to the left and right in FIGS. 1, 3 and 4.

Figure 1:
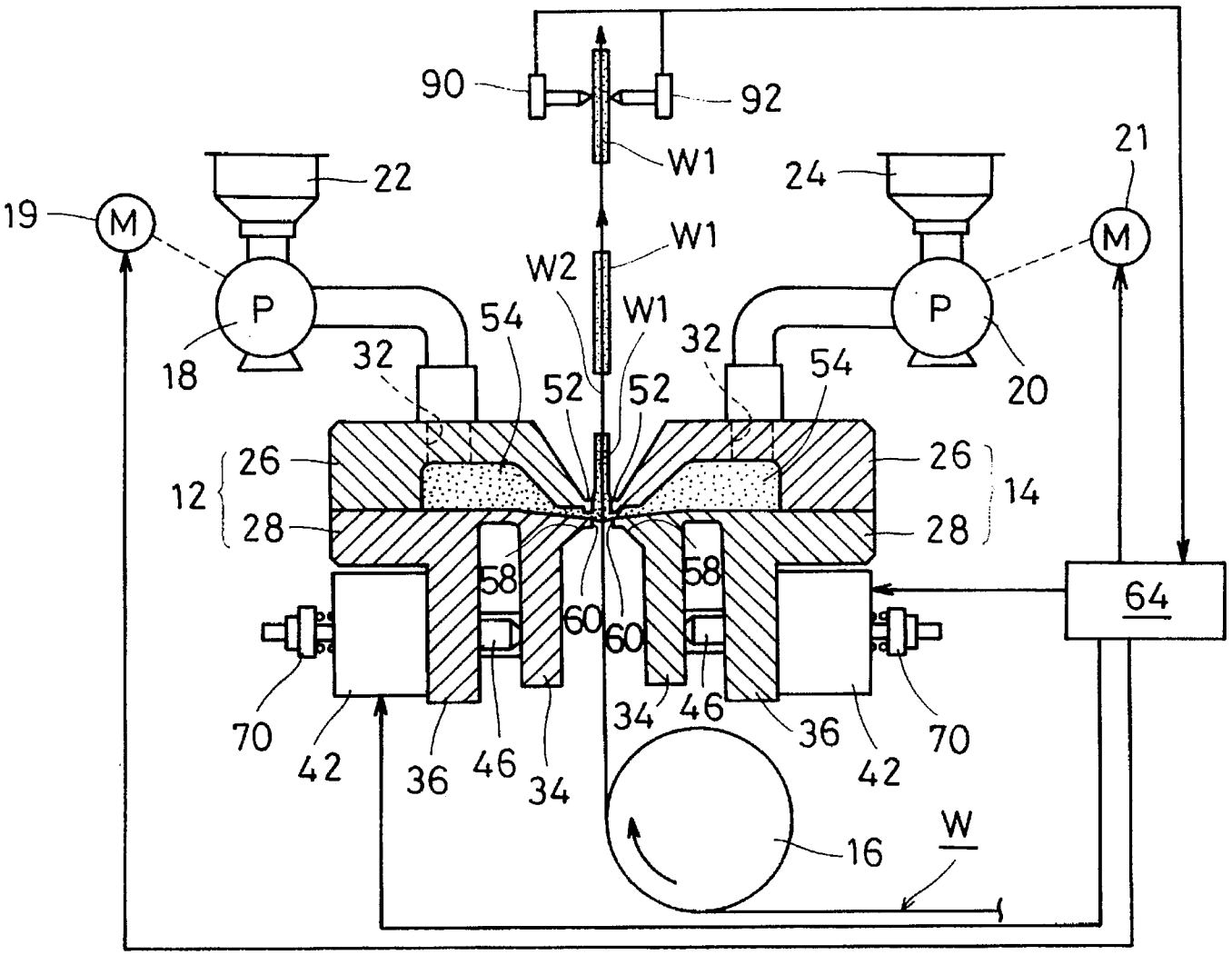
FIG. 1 is a general view of a coating apparatus according to one embodiment of the present invention.
Figure 2:
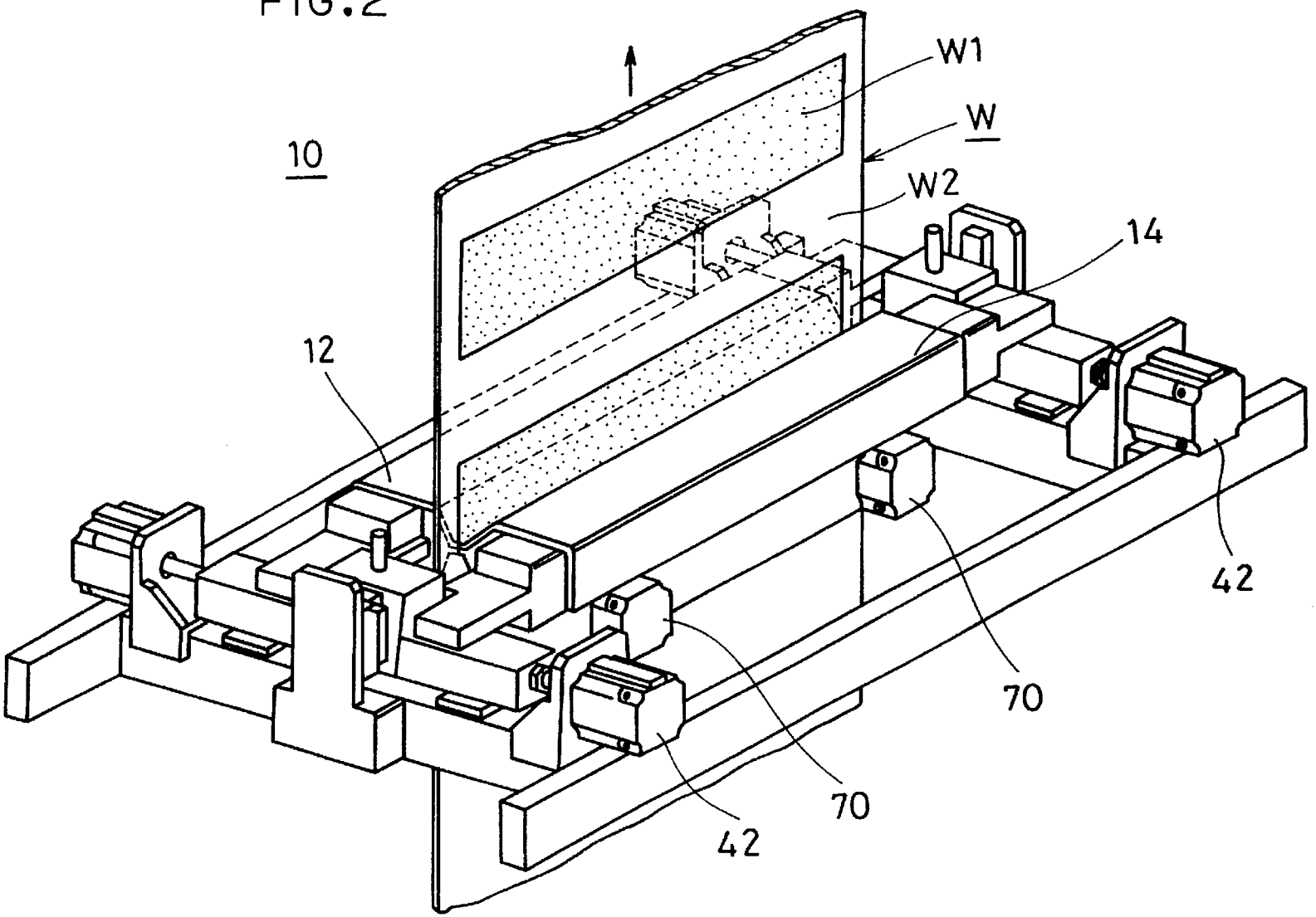
FIG. 2 is a perspective view of the coating apparatus.

Referring first to FIGS. 1 and 2, the overall structure of the duplex type coating apparatus 10 will be described.

A web W is moved up along a vertical path between a pair of left and right dies 12, 14. The distance between the pair of left and right dies 12, 14 is substantially the same as the width of the web W. Details of the pair of left and right dies 12, 14 are described below.

A guide roll directs the web W between the pair of left and right dies 12, 14. Constant delivery pumps 18, 20 feed a constant amount of coating liquid from coating liquid tanks 22, 24 to the pair of left and right dies 12, 14. Motors 19, 21 drive the constant delivery pumps 18, 20 at a rate given by a constant rotational number N. The constant delivery pumps 18, 20 are rotated by the motors 19, 21 and provide a constant amount of coating liquid per one rotation of the pump. To increase the supply of the coating liquid, it is necessary to increase the number of rotation of the motors 19, 21.

Coating thickness sensors detect the thickness of a coating applied on both sides of the web W. The coating thickness sensors 90, 92 take the form of beta or infrared ray thickness gauges. The coating thickness sensors 90, 92 detect the thickness of a coating liquid in wet or dry state. The coating thickness sensors 90, 92 are moved at a constant speed in the width-wise direction of the web W to detect the thickness of the coating. The web W is divided into seven sections along its width. During movement, the coating thickness sensors 90, 92 detect the average thickness of a coating applied to each one of the seven sections on either side of the web W. The average thicknesses of the seven sections on either side of the web W are then used to provide a median thickness on either side of the web.

Reference will now be made to details of the pair of left and right dies 12, 14. The dies 12, 14 are laterally symmetrical. The left die 12 will first be described with reference to FIGS. 3 and 4.

The left die 12 is vertically separable and includes an upper body 26 and a lower body 28. A recess 30 is formed in the lower surface of the upper body 26. An inlet port 32 extends from the recess 30 and receives a coating liquid from the pump 18. When the upper body 26 and the lower body 28 are assembled together, the open side of the recess 30 is closed by the upper surface of the lower body 28 to define a liquid reservoir 54.

The right lower end of the upper body 26 projects to form a stationary lip 52. An outlet port 56 is formed between the stationary lip 52 and the liquid reservoir 54.

Similarly, the right lower end of the lower body 28 projects to form a movable lip 58. A discharge port 60 is formed between the stationary lip 52 and the movable lip 58.

A first projection 34 and a second projection 36 depend from the lower body 28. The first projection 34 is located closer to the path of travel of the web than the second projection 36. A thin interconnecting portion 38 provides a connection between the first projection 34 and the second projection 36. A portion of the lower body 28 at the left side of the second projection 36 is secured to the upper body 26 by bolts 40.

A pair of front and rear air cylinders 42 are provided at opposite ends of the second projection 36 (see FIG. 2). Structure of the air cylinders 42 is as follows (see FIG. 3).

The air cylinder 42 is fixed to the left side of the second projection 36 and includes a drive or cylinder section 46. The cylinder section 46 extends through a through hole 48 of the second projection 36 and has a front end contacted with the left side of the first projection 34. The cylinder section 46 is moved to the right to urge the first projection 34 to the right.

The timing of operation of the air cylinders 42 and the pumps 18, 20 is controlled by a control unit 64.

A pair of front and rear biasing units 70, 70 are located between the pair of air cylinders 42, 42 (see FIG. 2). Structure of the biasing unit 70 is as follows (see FIG. 4).

A second seat 78 extends horizontally through and threadingly engaged with a through hole of the second projection 36. The second seat 78 is secured in position by a locking nut 80. The second seat 78 has a through bore 82 through which a rod 72 extends. The rod 72 is movable through the through bore 82 and has a right end connected to the first projection 34.

A coiled compression spring 74 is disposed around the rod 72 and has a left end secured to a first seat 76 and a right end secured to the second seat 78. The first seat 76 is secured to the left end of the rod 72.

The biasing unit 70 thus constructed deflects the thin interconnecting portion 38 and constantly biases the second projection 36 to the left.

Operation of the left die 12 is as follows.

Figure 4:
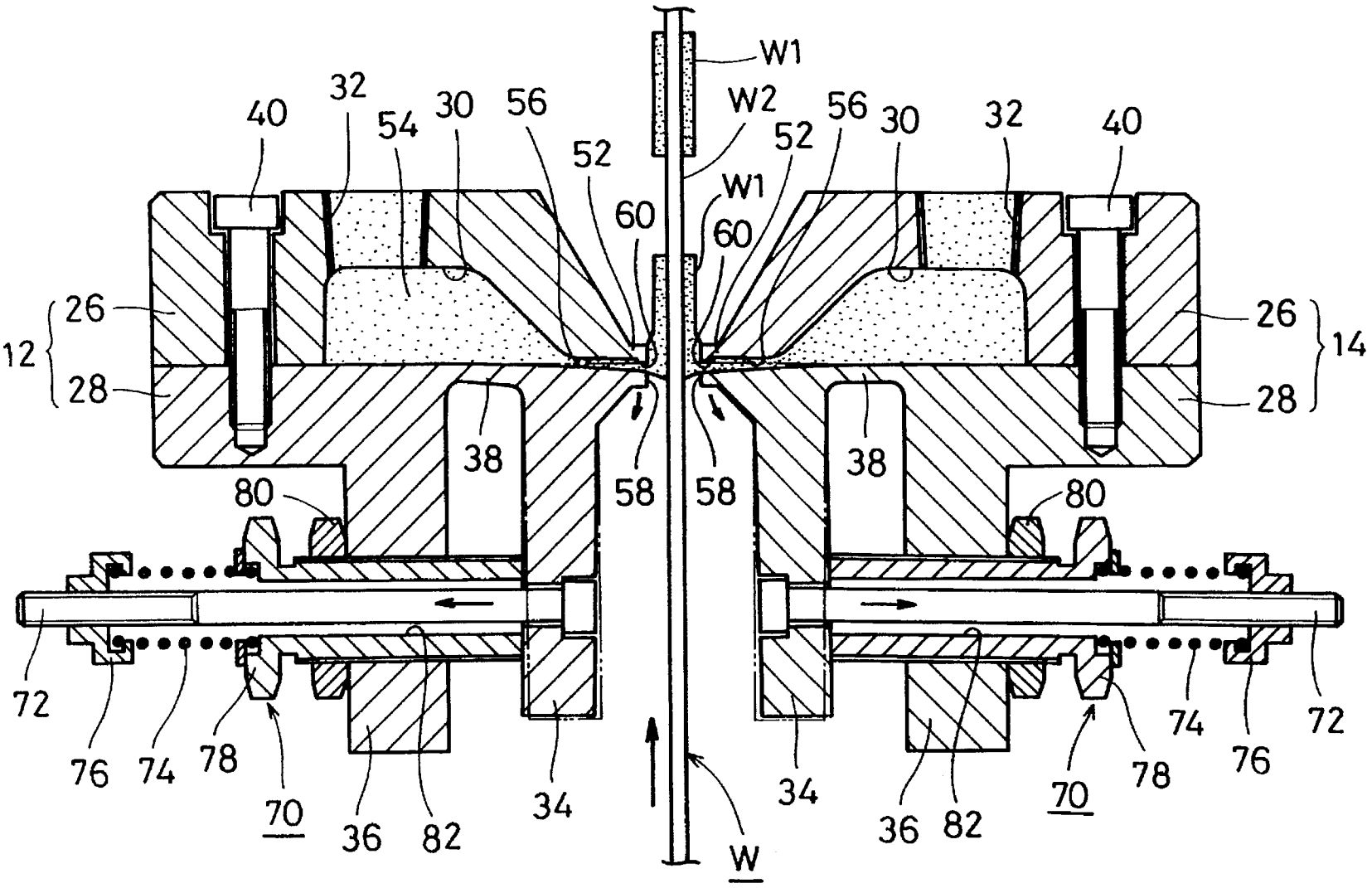
FIG. 4 is a sectional view of the pair of dies with associated biasing units.

(1) As shown in FIG. 4, the second projection 36 is normally biased to the left by the biasing unit 70. The lower body 28 is downwardly deflected at the interconnecting portion 38 to slightly separate the movable lip 58 from the stationary lip 52. In this state, a coating liquid within the liquid reservoir 54 is discharged from the discharge port 60 through the outlet port 56.

Figure 3:
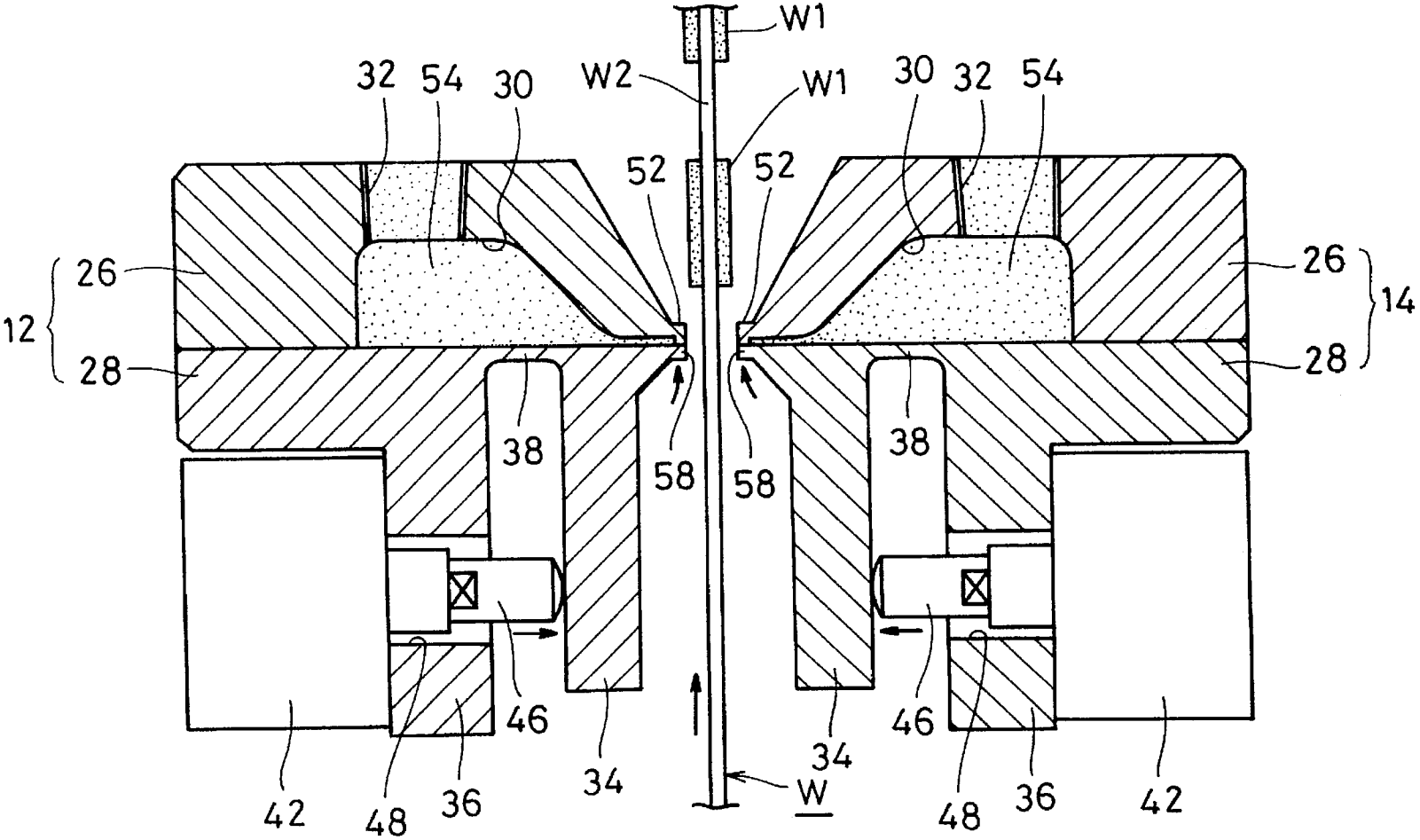
FIG. 3 is a sectional view of a pair of right and left dies with associated air cylinders.

(2) When the air cylinder 42 is operated to cause the cylinder section 46 to urge the second projection 36 against the action of the biasing unit 70, the movable lip 58 is raised as shown in FIG. 3. This completely closes the discharge port 60. Accordingly, the coating liquid within the liquid reservoir 54 is no longer discharged from the discharge port 60. The discharge port 60 is again opened under the bias of the biasing unit 70 when the air cylinder 42 no longer presses the second projection 36.

Although reference has been made to the structure of the left die 12, the right die 14 has an identical structure, but is a mirror image of the left die 12.

Reference will next be made to operation of the entire coating apparatus 10.

The web W is directed to the pair of dies 12, 14 through the guide roll 16 and then, moved up along a vertical path between the pair of dies 12, 14.

The pumps 18, 20 feed a constant and identical amount of coating liquid within the tanks 22, 24 to the pair of dies 12, 14.

To form a coated area W1 on both sides of the web W, the air cylinder 42 is rendered inoperative to keep the discharge port 60 open. In this state, a coating liquid is discharge from the the pair of discharge ports 60, 60 and applied to opposite sides of the web W by the same amount. Since the same amount of coating liquid is applied to the opposite sides of the web W, the coating on the opposite sides of the web W has the same thickness. The flow rate of the coating liquid is controlled by the control unit 64 and may vary depending on the width of the web W, the speed of the web W, and the thickness of a coating. If the web W is laterally displaced, the thickness of a coating will in no way be changed since the amount of the coating liquid applied is constant. This control will be described later.

To form a uncoated area W2, the air cylinder 42 is rendered operative to close the discharge port 60. Thus, no coating liquid is discharged from the pair of discharge ports 60, 60. When the uncoated area W2 is long, the control unit 64 is operable to move the cylinder section 46 and stop the supply of coating liquid from the pumps 18, 20. This prevents an increase in the internal pressure within the liquid reservoir 54 due to closing of the discharge port 60. The pumps 18, 20 may be continuously operated when the discharge port 60 is closed only for a few seconds. In such a case, an increase in the internal pressure is negligible.

Reference will now be made to two different control methods of maintaining the thickness of a coating on opposite sides of the web W constant by applying the same amount of coating liquid to the opposite sides of the web W.

A first control method is described below.

With the coating apparatus 10 of this embodiment, the same amount of coating liquid under pressure is applied from the dies 12, 14 to the web W. Thus, the thickness of a coating depends on the pumping rate of the constant delivery pumps 18, 20. That is, the pumping rate of the constant delivery pumps 18, 20 is determined by the speed of the web and the product of the coating width times the coating thickness, namely, the volume of the coating.

In this case, the coating thickness is the thickness of a wet coating. The flow rate of the coating liquid depends on the number of rotation of the constant delivery pumps 18, 20. Importantly, to maintain the thickness of a coating on opposite sides of the web W constant, it is necessary to eject the same amount of coating liquid from the dies 12, 14. To this end, the constant delivery pumps 18, 20 have to be operated in the same manner so as to feed the same amount of coating liquid.

The rotational number N (r.p.m.) of the constant delivery pumps 18, 20 is represented by the equation (1).

$$N=(D\times W\times V)/(K1\times Q) \quad (1)$$

where D is the thickness of a wet coating (mm), W is the coating width (mm), V is the speed of the web (m/min), Q is the amount (cc/REV) of coating liquid per one rotation of the constant delivery pumps 18, 20, and K1 is a constant.

The factor Q can be a constant once the type of the constant delivery pumps 18, 20 is determined. Thus, the equation (1) can be changed to $$N=(D\times W\times V)/K2 \quad (2)$$

Where K2=K1×Q.

Now, numerical information on the thickness D and width W of the wet coating is sent to the control unit 58. Also, numerical information on the speed V of the web W is sent to the control unit 64 through an A/D converter. Then, the control unit 64 is operable to rotate the motor 19, 21 for the constant delivery pumps 18, 20 at a speed as determined by the equation (2).

Under this control, the rotational number of the constant delivery pumps 18, 20 can automatically follow a change in the web speed V and can apply the coating liquid to the web constantly with the same thickness and width.

A second control method will now be described.

There would be no change in the coating thickness and width during a coating operation. Thus, the coating thickness D and width W in the equation (2) can be constants. Accordingly, the equation (2) may be represented as follows.

$$N=K3\times V \quad (3)$$

where $$K3=D\times W/K2 \quad (3')$$

Although the factor K3 considers the coating thickness D, it is subject to change. A change in the coating thickness D, if occurring, should be considered in determining K3. To this end, a median thickness Dp relative to the entire width is measured by the coating thickness sensors 90, 92. Taking only the coating thickness into account, which is different from the equation (3'), K3 may be represented by the following equation.

$$K3=Ds/Dp\times K0 \quad (4)$$

where Ds is the required thickness of a coating, and K0 is a constant.

K3 as determined by the equation (4) is substituted in the equation (3). Then, the rotational number of the constant delivery pumps 18, 20 corresponding to the required coating thickness is represented by the equation (5).

$$N=(Ds\times V\times K0)/Dp \quad (5)$$

In this way, the rotational number of the constant delivery pumps 18, 20 automatically follows a change in the feeding speed of the web W and applies the coating liquid to the web constantly with the same thickness and width.

The thickness of a coating on the web is controlled by these two control methods. Under either control, a coating on opposite sides of the web W can have the same thickness.

With the coating apparatus 10 thus constructed, the same amount of coating liquid is fed from the pair of dies 12, 14. This ensures the same thickness of a coating on opposite sides of the web W even if the web is slightly laterally displaced relative to the path of travel of the web W.

The coated area W1 and uncoated area W2 can readily be formed by opening and closing the discharge ports 60. Also, the length of the coated area W1 and the uncoated area W2 can be adjusted by controlling operating time of the air cylinders 42 by means of the control unit 64.

The liquid reservoirs 54 are cleaned by vertically separating the upper body 26 and the lower body 28.

In the foregoing embodiment, the movable lip 58 is moved by the air cylinder 42. The air cylinder 42 may be replaced by a motor.

In the foregoing embodiment, the discharge port 60 is opened under the bias of the biasing means 70. Alternatively, the discharge port 60 may be closed under the bias of the biasing means 70 and then, opened by the air cylinder 42.

Figure 5:
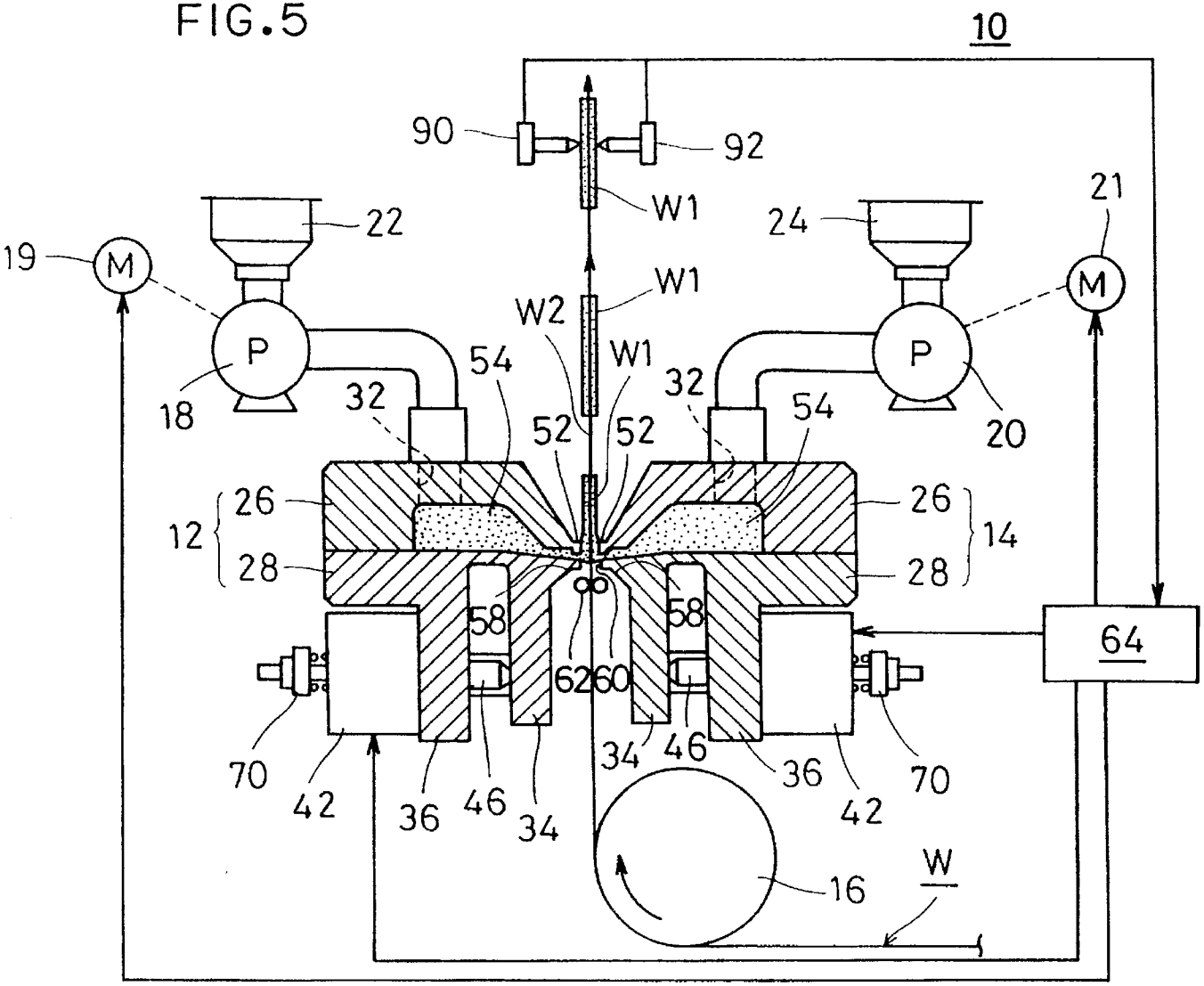
FIG. 5 is a general view of the coating apparatus with additional stationary bars.

A significant advantage of the coating apparatus 10 is that a coating on the web has the same thickness even if the web W is slightly displaced in a lateral direction. In order to prevent lateral displacement of the web W, a pair of stationary bars 62, 62 may be mounted adjacent to the lower end of the movable lips 58 as shown in FIG. 5. By this arrangement, the web W is moved between the stationary bars 62, 62 to prevent lateral displacement of the web.

Means for preventing lateral displacement of the web W is not limited to the stationary bars 62, 62 and may take any other forms.

Also, in the foregoing embodiment, the web W is moved in a vertical direction. Alternatively, the web W may be moved in a horizontal or oblique direction. In such a case, a pair of dies should be oriented in a horizontal or oblique direction.

What is claimed is:

1. A duplex type coating apparatus for applying a coating liquid to a web, comprising:

a pair of dies arranged at opposite sides of a path of travel of the web while said web moves at a specified rate:

a pair of coating liquid reservoirs defined within respective ones of said pair of dies;

said pair of dies each having one of a pair of discharge ports placed on opposite sides of the path of travel of the web along a width thereof and for discharging said coating liquid from said pair of liquid reservoirs onto said web; and coating liquid supply means for supplying said coating liquid to said pair of liquid reservoirs at a specific supply amount per unit time based upon a rate of travel of the web multiplied by a preset coat thickness and a preset coat width to simultaneously apply substantially the same amount of said coating liquid to said opposite sides of the web through said pair of discharge ports to deposit the coating liquid on said web at said preset coat thickness and said preset coat width.

2. A duplex type coating apparatus according to claim 1, wherein said pair of discharge ports of said pair of dies are independently openable and closeable, and further comprising means for opening and closing said pair of discharge ports in synchronization with movement of the web to selectively apply the coating, liquid the opposite sides of said web to form coated regions and non-coated regions longitudinally alternating on each side of said web.

3. A duplex type coating apparatus according to claim 2, wherein:

each of said pair of discharge ports includes a stationary lip fixed to said die and a movable lip movable relative to said stationary lip and movably attached to said die; and wherein said means for opening and closing includes means for moving said movable lip into mating engagement with said stationary lip to close said discharge port and moving said movable lip apart from said stationary lip to open said discharge port.

4. A duplex type coating apparatus according to claim 3, wherein said means for moving includes:

biasing means for biasing said movable lip in a direction to open said discharge port; and closing means for bringing said movable lip and said stationary lip into mating engagement with each other against the bias of said biasing means.

5. A duplex type coating apparatus according to claim 3, wherein said means for moving includes:

biasing means for biasing said movable lip in a direction to close said discharge port; and opening means for moving said movable lip away from said stationary lip against the bias of said biasing means to open said discharge port.

6. A duplex type coating apparatus according to claim 1, further comprising:

web speed sensor means for detecting a speed V of travel of said web; and wherein said coating liquid supply means includes:

constant delivery pumps for providing a constant amount of coating liquid per rotation and feeding the same amount of coating liquid to said pair of dies; and first control means for controlling rotational number determining a rate of rotation of said constant delivery pumps based on the web speed V as detected by said web speed sensor means as follows:

$$N=(D\times W\times V)/(K1\times Q)$$

where D is required thickness of a wet coating corresponding to said preset coat thickness, W is a required width of the coating on the web, Q is an amount of the coating liquid discharged per one rotation of the constant delivery pump, and K1 is a constant.

7. A duplex type coating apparatus according to claim 1, further comprising:

web speed sensor means for detecting a speed V of travel of the web; and wherein said coating liquid supply means includes:

constant delivery pumps for providing a constant amount of coating liquid per rotation and feeding the same amount of coating liquid to said pair of dies;

coating thickness sensor means for detecting a median thickness Dp of the coating alone a width-wise direction of said web; and second control means for controlling rotational number determining a rate of rotation of said constant delivery pumps based on the web speed V as detected by said web speed sensor means and the median coating thickness Dp as detected by said coating thickness sensor means as follows:

$$N=(Ds\times V\times K0)/Dp$$

where Ds is the required thickness of a wet coating corresponding, to said preset coat thickness, and K0 is a constant.

8. A duplex type coating apparatus for applying a coating liquid to a web, comprising:

a pair of dies arranged at opposite sides of a path of travel of the web while said web moves at a specified rate;

said pair of dies each having one of a pair of discharge ports placed on opposite sides of the path of travel of the web along a width thereof and for discharging said coating liquid onto said web; and coating liquid supply means for supplying said coating liquid to said pair of dies at a specific supply amount per unit time based upon a rate of ravel of the web multiplied by a preset coat thickness and a preset coat width to simultaneously apply substantially the same amount of said coating liquid to said opposite sides of the web through said pair of discharge ports to deposit the coating liquid on said web at said preset coat thickness and said preset coat width.

9. A duplex type coating apparatus according to claim 8, further comprising:

web speed sensor means for detecting a speed V of travel of said web; and wherein said coating liquid supply means includes:

constant delivery pumps for providing a constant amount of coating liquid per rotation and feeding the same amount of coating liquid to said pair of dies; and first control means for controlling rotational number determining a rate of rotation of said constant delivery pumps based on the web speed V as detected by said web speed sensor means as follows:

$$N=(D\times W\times V)/(K1\times Q)$$

where D is required thickness of a wet coating corresponding to said preset coat thickness, W is a required width of the coating on the web, Q is an amount of the coating liquid discharged per one rotation of the constant delivery pump, and K1 is a constant.

10. A duplex type coating apparatus according to claim 8, further comprising:

web speed sensor means for detecting a speed V of travel of the web; and said coating liquid supply means includes:

constant delivery pumps for providing a constant amount of coating liquid per rotation and feeding the same amount of coating liquid to said pair of dies;

coating thickness sensor means for detecting a median thickness Dp of the coating along a widthwise direction of said web; and second control means for controlling rotational number determining a rate of rotation of said constant deliver pumps based on the web speed V as detected by said web speed sensor means and the median coating thickness Dp as detected by said coating thickness sensor means as follows:

$$N=(Ds\times V\times K0)/Dp$$

where Ds is the required thickness of a wet coating corresponding to said preset coat thickness, and K0 is a constant.

* * * * *